United States Patent [19]

Frankenberg

[11] Patent Number: 4,753,537

[45] **Date of Patent: * Jun. 28, 1988**

[54] DIGITAL CLOCK CONSTRUCTION, PINION GEAR THEREFOR AND METHODS OF MAKING THE SAME

[75] Inventor: Alfred A. Frankenberg, Knoxville, Tenn.

[73] Assignee: Robertshaw Controls Company, Richmond, Va.

[ * ] Notice: The portion of the term of this patent subsequent to Mar. 31, 2004 has been disclaimed.

[21] Appl. No.: 945,394

[22] Filed: Dec. 23, 1986

Related U.S. Application Data

[63] Continuation of Ser. No. 796,903, Nov. 12, 1985, Pat. No. 4,653,932.

[51] Int. Cl.[4] ..... G04B 29/00

[52] U.S. Cl. ..... 368/323; 368/322; 74/462; 74/460

[58] Field of Search ..... 368/322, 323, 220; 74/462, 460

[56] References Cited

U.S. PATENT DOCUMENTS

| | | | |
|---|---|---|---|
| 610,840 | 10/1898 | Gleason | 74/460 |
| 3,965,668 | 6/1976 | Tomokazu et al. | 368/227 |
| 4,200,000 | 4/1980 | Flüehmann | 368/107 |

*Primary Examiner*—Bernard Roskoski

*Attorney, Agent, or Firm*—Candor, Candor & Tassone

[57] ABSTRACT

A digital clock construction, a pinion gear therefor and methods of making the same are provided, the clock construction comprising a frame, first and second time indicating drums each being rotatably carried by the frame, and a pinion gear rotatably carried by the frame and having driving gear teeth disposed in meshing relation with an annular internal gear of the second drum whereby rotation of the pinion gear causes rotation of the second drum, the pinion gear having locking teeth extending from certain of the driving teeth thereof, the first drum having an annular internal locking surface that is adapted to slide against a pair of locking teeth to hold the pinion gear from rotation thereof while the first drum is being rotated through certain timed increments of movement thereof, the first drum having a pair of kicker teeth for meshing with the driving teeth of the pinion gear to rotate the pinion gear when the first drum is being rotated through a particular one of the timed increments of movement thereof, the first drum having a relief in the locking surface thereof that is located adjacent the kicker teeth thereof for receiving one of the locking teeth therein as the pinion gear is being rotated by the kicker teeth, the locking teeth each having a part thereof that is adapted to cooperate with the relief to prevent any substantial rotation of the pinion gear in one direction thereof after the first drum has completed the particular timed increment of movement thereof and that respective locking tooth is in alignment with the relief so as to be out of engagement with the locking surface.

6 Claims, 6 Drawing Sheets

DIGITAL CLOCK CONSTRUCTION, PINION GEAR THEREFOR AND METHODS OF MAKING THE SAME

CROSS REFERENCE TO RELATED APPLICATION

This application is a continuation patent application of its copending parent patent application, Ser. No. 796,903, filed Nov. 12, 1985, now issued on Mar. 31, 1987 as U.S. Pat. No. 4,653,932.

BACKGROUND OF THE INVENTION

1. Field of the Invention

This invention relates to a new digital clock construction and to a new pinion gear therefor as well as to new methods of making such a digital clock construction and such a pinion gear.

2. Prior Art Statement

It is known to provide a digital clock construction comprising a frame means, first and second time indicating drum means each being rotatably carried by the frame means, the second drum means having an annular internal gear means, and a pinion gear rotatably carried by the frame means and having drive gear teeth disposed in meshing relation with the internal gear means whereby rotation of the pinion gear causes rotation of the second drum means, the pinion gear having locking teeth extending from certain of the driving teeth thereof, the first drum means having an annular locking surface that is adapted to slide against a pair of the locking teeth to hold the pinion gear from rotation thereof while the first drum means is being rotated through certain timed increments of movement thereof, the first drum means having a pair of kicker teeth for meshing with the driving teeth of the pinion gear to rotate the pinion gear when the first drum means is being rotated through a particular one of the timed increments of movement thereof, the first drum means having means defining a relief in the locking surface thereof that is located adjacent the kicker teeth thereof for receiving one of the locking teeth therein as the pinion gear is being rotated by the kicker teeth. For example, see FIG. 19 of the drawings of this application.

SUMMARY OF THE INVENTION

It is one feature of this invention to provide a new digital clock construction that has means to accurately align the time indicating drum means thereof in the window area thereof.

In particular, it was found according to the teachings of this invention that the prior known pinion gear of the prior known digital clock construction does not provide for a good lockup of the hour indicating drum means each time the hour indicating drum means is advanced one increment by the pinion gear because each time of the locking teeth of the pinion gear is still registered with the relief portion of the locking surface of the cooperating ten minute indicating drum means so as to permit substantial movement of the pinion gear and thus of the hour indicating drum means so that the indicated time thereon was not accurately aligned with the other time indicating drum means so as to present an uneven or misaligned numbering arrangement in the window area of the prior known clock construction.

However, it was found according to the teachings of this invention that unique means can be provided on the locking teeth of the pinion gear to cooperate with a unique portion of the relief in the cooperating locking surface so as to prevent any substantial rotation of that pinion gear in one direction thereof after the driving time indicating drum means has completed a particular time increment of movement thereof even though a locking tooth is still in alignment with the relief so as to be out of engagement with the locking surface.

For example, one embodiment of this invention provides a digital clock construction comprising a frame means, first and second time indicating drum means each being rotatably carried by the frame means, the second drum means having an annular internal gear means, and a pinion gear rotatably carried by the frame means and having driving gear teeth disposed in meshing relation with the internal gear means whereby rotation of the pinion gear causes rotation of the second drum means, the pinion gear having locking teeth extending from certain of the driving teeth thereof, the first drum means having an annular internal locking surface that is adapted to slide against a pair of the locking teeth to hold the pinion gear from rotation thereof while the first drum means is being rotated through certain timed increments of movement thereof, the first drum means having a pair of kicker teeth for meshing with the driving teeth of the pinion gear to rotate the pinion gear when the first drum means is being rotated through a particular one of the timed increments of movement thereof, the first drum means having means defining a relief in the locking surface thereof that is located adjacent the kicker teeth therefor for receiving one of the locking teeth therein as the pinion gear is being rotated by the kicker teeth, the locking teeth each having a pair thereof that is adapted to cooperate with the relief to prevent any substantial rotation of the pinion gear in one direction thereof after the first drum means has completed the particular timed increment of movement thereof and that respective locking tooth is in alignment with the relief so as to be out of engagement with the locking surface.

Accordingly, it is an object of this invention to provide a new digital clock construction having one or more of the novel features of this invention as set forth above or hereinafter shown or described.

Another object of this invention is to provide a new method for making such a digital clock construction, the method of this invention having one or more of the novel features of this invention as set forth above or hereinafter shown or described.

Another object of this invention is to provide a new pinion gear for a digital clock construction, the pinion gear of this invention having one or more of the novel features of this invention as set forth above or hereinafter shown or described.

Another object of this invention is to provide a new method of making such a pinion gear, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
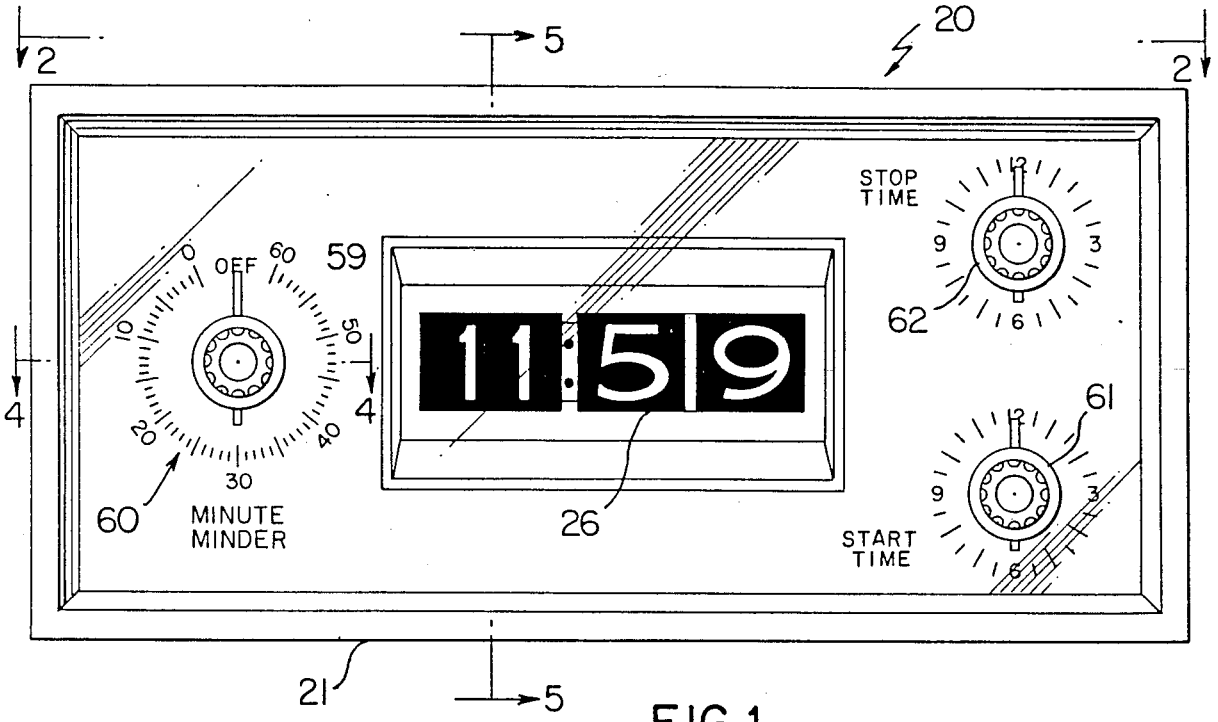
FIG. 1 is a front view of the new digital clock construction of this invention.

While the various features of this invention are hereinafter illustrated and described as being particularly adapted to provide a digital clock construction for a cooking apparatus, it is to be understood that the various features of this invention can be utilized singly or in various combinations thereof to provide a digital clock construction for other uses as desired.

Therefore, this invention is not to be limited to only the embodiment illustrated in the drawings, because the drawings are merely utilized to illustrate one of the wide variety of uses of this invention.

Figure 2:
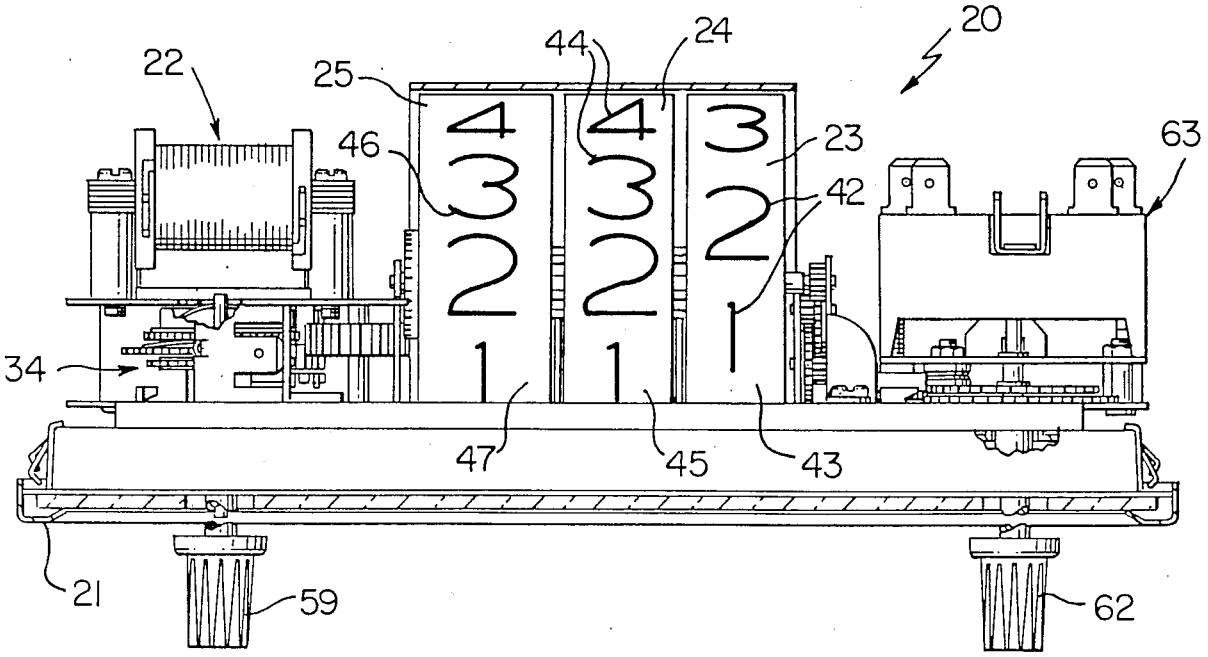
FIG. 2 is a top view of the clock construction of FIG. 1 with certain parts thereof being shown in cross section and being taken in the direction of the arrows 2—2 of FIG. 1.
Figure 3:
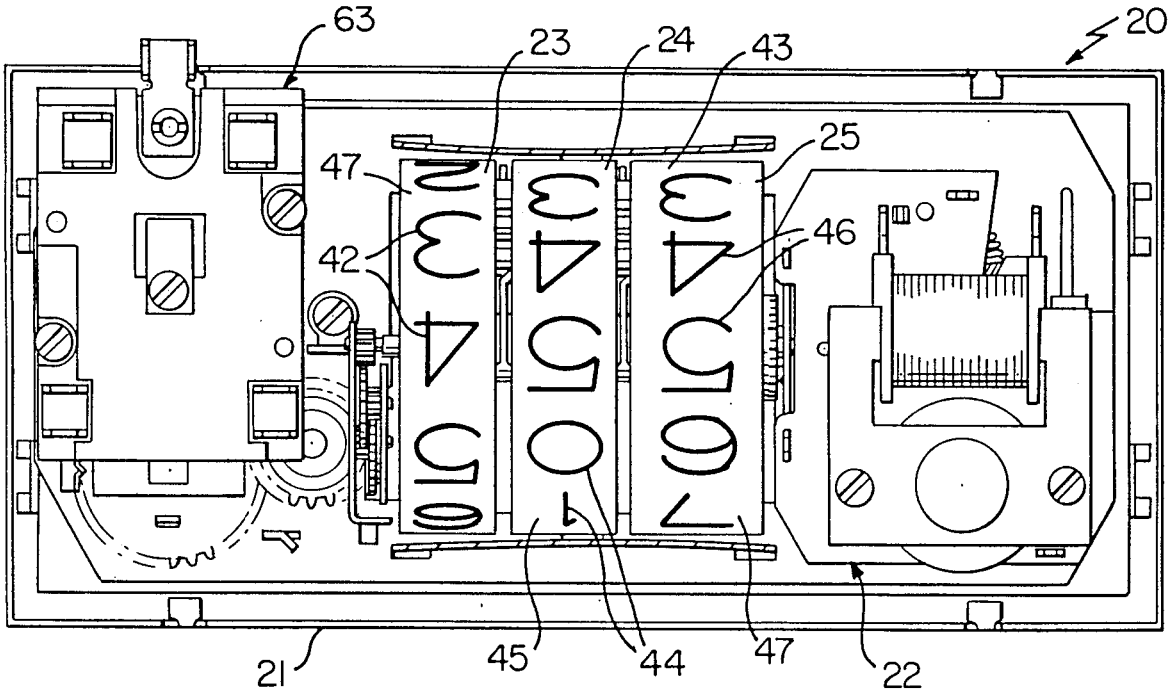
FIG. 3 is a back view of the clock construction of FIG. 1 with certain parts thereof being shown in cross section.

Referring now to FIGS. 1-3, the new clock construction of this invention is generally indicated by the reference numeral 20 and comprises a frame means 21 carrying an electrically operated motor means that is conventional in the art and is generated indicated by the reference numeral 22, the motor means 22 driving in a timed sequence in a manner hereinafter set forth a plurality of time indicating drum means 23, 24 and 25 that are carried by the frame means 21 and indicate the time of day in a window means 26 of the clock construction 20 as illustrated in FIG. 1.

The drum means 23-25 are respectively disposed on a shaft means 27, FIG. 6, that has opposed ends 28 and 29 thereof rotatably disposed in suitable openings 30 and 31 formed in frame parts 32 and 33 of the frame means 21 so that the shaft means 27 is adapted to be rotated relative to the frame means 21 by the drive motor means 22 in the manner hereinafter described by the drive train means of the clock construction 20 that is generally indicated by the reference numeral 34 in FIG. 4.

The time indicating drum means 23 has a central hub 35 receiving the shaft means 27 through a central opening 36 thereof with the shaft means 27 having a knurled or splined portion 37 press fitted into the opening 36 of the hub 35 so that the drum means 23 rotates in unison with the shaft means 27 whereas the drum means 24 and 25 are adapted to rotate relative to the shaft means 27 as will be apparent hereinafter.

The drum means 24 and 25 respectively have the shaft means 27 passing through central openings 38 and 39 of the central hubs 40 and 41 thereof with the hubs 35, 40 and 41 of the drum means 23-25 being disposed in aligned stacked relation on the shaft means 27 but being movable relative to each other as will be apparent hereinafter.

The drum means 23, in a manner well known in the art, comprises a minute indicating drum means and has numbers 42 disposed on the outer peripheral surface 43 thereof from "0" to "9" so that each number 42 on the minute indicating drum means 23 is disposed approximately 36° from an adjacent number 42 thereon.

In contrast, the drum means 24, in a manner well known in the art, comprises a ten minute indicating drum means and has twelve numbers 44 disposed about the outer peripheral surface 45 thereof with the first six numbers being "0" to "5" and the next six numbers being from "0" to "5" so that each number 44 on the ten minute indicating drum means 24 is disposed approximately 30° from an adjacent number 44 thereon.

In a similar manner, the time indicating drum means 25, in a manner well known in the art, comprises an hour indicating drum means and has twelve numbers 46 disposed on the outer peripheral surface 47 thereof from "1" to "12" so that the numbers 46 on the hour indicating drum means 25 are each disposed approximately 30° from an adjacent number 46 thereon.

A pair of pinion gear means that are respectively generally indicated by reference numerals 48 and 49 in FIG. 6 cooperate with the drive means 34 and the drum means 23-25 in a manner hereinafter set forth to cause the minute drum means 23 to intermittently rotate approximately 36° after the lapsing of each minute of time with the pinion gear means 48 causing the ten minute drum means 24 to rotate approximately 30° every tenth increment of movement of the minute drum means 23 and with the pinion gear means 49 causing the hour indicating drum means 25 to rotate approximately 30° during each sixth increment of movement of the ten minute indicating drum means 24 so that the drum means 23-25 will provide the proper time of day at the window means 26 in the manner illustrated in FIG. 1 and in a manner well known in the art.

Figure 4:
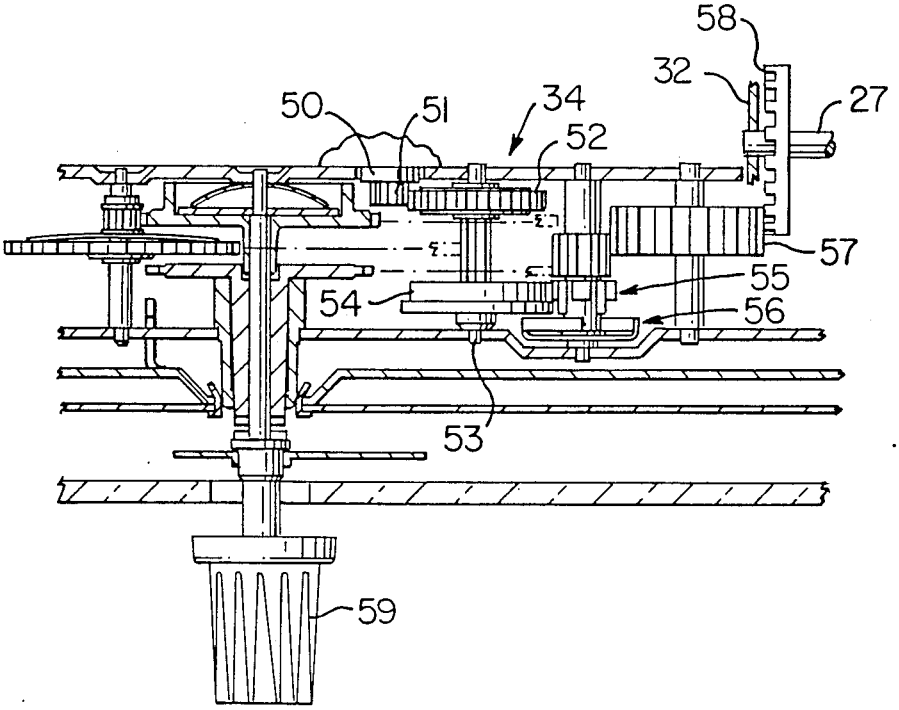
FIG. 4 is an enlarged fragmentary cross-sectional view and schematically illustrates the drive structure of the clock construction of FIG. 1, FIG. 4 being taken generally in the direction of the arrows 4—4 of FIG. 1.

The electrically operated motor means 22, in a manner conventional in the art, has a rotor 50, FIG. 4, that continuously rotates and has a pinion gear 51 disposed thereon and in meshing relation with a pinion gear 52 fixed to a shaft means 53 that is rotatably carried by the frame means 21 and has a pinion gear means 54 thereon that is disposed in meshing relation with a gear means 55 of a Geneva clutch means 56 that drives a pinion gear 57 that is disposed in meshing relation with a gear means 58 fixed to the shaft means 27 so that the shaft means 27 is intermittently rotated approximately 36° each minute and thereby causes the minute indicating drum means 23 to serially change the minute indicating number 41 at the window means 26 once a minute, such each incremental movement of the shaft 27 and minute indicating drum means 23 taking place during approximately five and a half seconds. The use of a Geneva clutch 56 for rotating the shaft 27 every minute is well known in the art whereas the particular Geneva clutch 56 illustrated in FIG. 4 is unique and is disclosed and claimed in the copending patent application of Larry V. Price, Ser. No. 796,902, filed Nov. 12, 1985 now U.S. Pat. No. 4,634,289 whereby such copending patent application is being incorporated into this disclosure by this reference thereto.

The clock construction 20 has a control knob means 59, FIGS. 1 and 4, for permitting the operator to manually set the time indicating position of the drum means 23–25 even though the motor means 22 is running and such use of a time setting knob means 59 for such purpose is well known in the art whereas the particular knob means 59 of the clock construction 20 of this invention is unique and is disclosed and claimed in the copending patent application of Jay L. Lewis, Ser. No. 651,573 filed Sept. 17, 1984, whereby this copending patent application is being incorporated into this disclosure by this reference thereto.

Therefore, since the use of a Geneva clutch means 56 to interconnect the motor means 22 to the shaft means 27 so as to intermittently rotate the shaft means 27 every minute and the use of a knob means 59 to permit an operator to mechanically set the position of the drum means 23–25 while the motor means 22 is continuously operating are both well known in the art, a further discussion of the operation of the drive train 34 and the detailed structure thereof need not be set forth in order to understand the features of this invention.

However, it can be seen the clock construction 20 of this invention comprises a range timer wherein the control knob means 59 is also adapted to set an interval timer means that is generally indicated by the reference numeral 60 in FIG. 1 with the motor means 22 operating the interval timer means 60 in a manner well known in the art. Also, the clock construction 20 has control knob means 61 and 62 as illustrated in FIG. 1 for selecting a desired start time and a desired stop means that the clock construction 20 is to operate a switch means that is generally indicated by the reference numeral 63 in FIGS. 2 and 3 for completing an electrical circuit to a cooking apparatus heating means to cause that heating means to start to operate when the indicated time of day of the clock construction 20 reaches the selected start time and terminates that operation of the heating means of the cooking operation when the selected stop time is reached by the indicated time of day of the clock construction 20 in a manner well known in the art.

Figure 6:
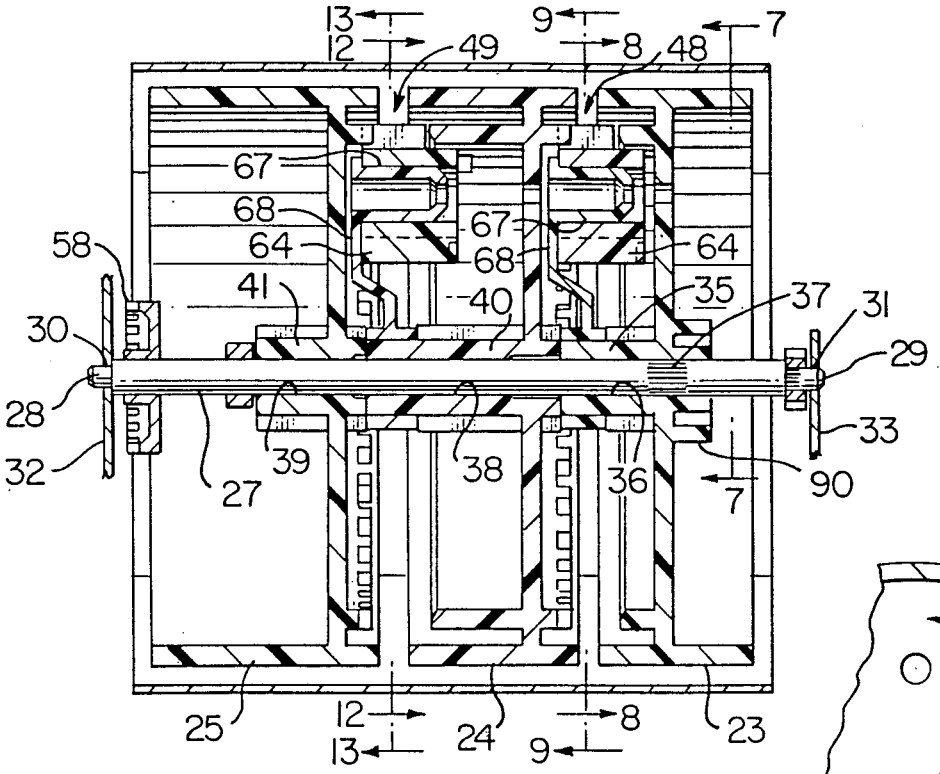
FIG. 6 is a fragmentary cross-sectional view taken on line 6—6 of FIG. 5.

The pinion gear means 48 and 49 of the clock construction 20 are substantially identical and each comprises a pinion gear 64 having a central hub 65 provided with an opening 66 therethrough so as to be rotatably disposed on a stub shaft means 67 of a pinion gear carrier 68 that has a hub portion 69 adapted to be rotated disposed on the respective hub portion 35 or 40 of the drum means 23 or 24 as illustrated in FIG. 6 and is provided with a slot means 70 that receives a part 71 of the frame means 21 therein so as to prevent rotation of the pinion carrier 68 in a manner well known in the art.

Each pinion gear 64 has a plurality of drive teeth 72 disposed about the outer periphery thereof, the drive teeth 72 being nine in number and being adapted to be disposed in meshing relation with an annular internal gear means 73 of its respective drum means 24 or 25 whereby rotation of the pinion gear 64 of the pinion gear means 48 will cause rotation of the ten minute drum means 24 and rotation of the pinion gear 64 of the pinion gear means 49 will cause rotation of the hour indicating drum means 25 in a manner well known in the art.

Figure 15:
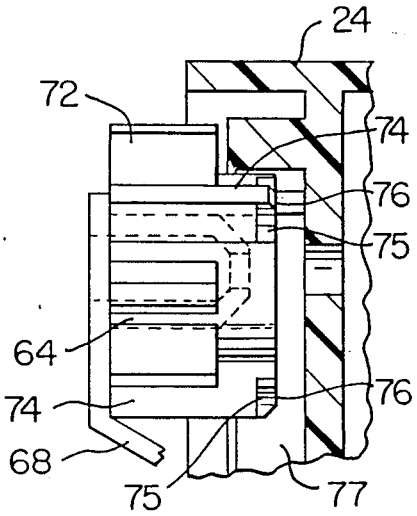
FIG. 15 is a fragmentary cross-sectional view taken on line 15—15 of FIG. 14.
Figure 17:
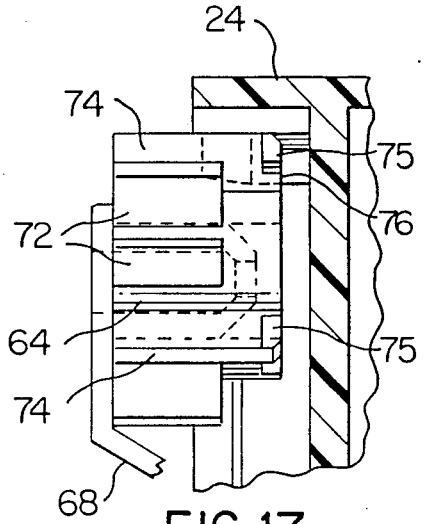
FIG. 17 is a fragmentary cross-sectional view taken on line 17—17 of FIG. 16.

Three of the driving teeth 72 of each pinion gear 64 have locking teeth 74 extending therefrom as illustrated in FIGS. 15 and 17 with the general profile of the locking teeth 74 being substantially the same as the general profile of the respective driving teeth 72 except for unique parts 75 at the free ends 76 of locking teeth 74 which will be hereinafter described.

Figure 19:
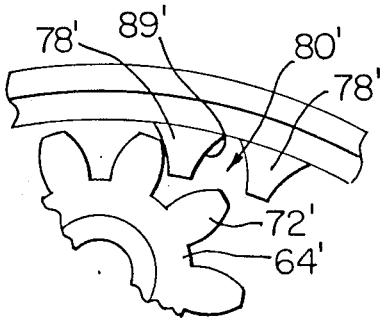
FIG. 19 PRIOR ART
FIG. 19 is a view similar to FIG. 18 and illustrates the prior known pinion gear and its cooperating time indicating drum means.

Thus, it can be seen that two driving gear teeth 72 of each pinion gear 64 are disposed between each adjacent pair of locking teeth 74 thereof and those two driving gear teeth 72 do not have locking teeth 74 extending therefrom, such an arrangement of driving teeth and locking teeth being well known in the art and being illustrated in FIG. 19 wherein parts similar to parts of this invention previously described are indicated by the same reference numeral followed by a prime mark. Thus, it can be seen that the prior art pinion gear 64' does not have the improved parts 75 of this invention on the locking teeth 74' thereof which provides for an improved alignment of the hour drum means 25 of this invention with the ten minute drum means 24 of this invention as will be apparent hereinafter.

Figure 8:
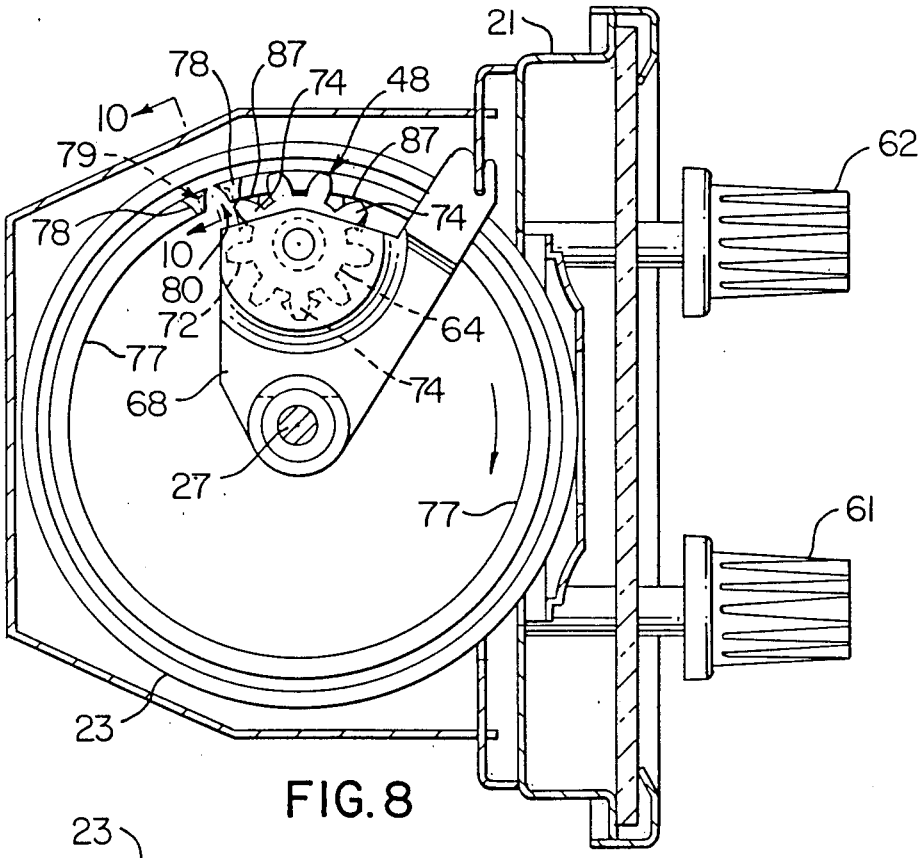
FIG. 8 is a cross-sectional view taken on line 8—8 of FIG. 6.
Figure 10:
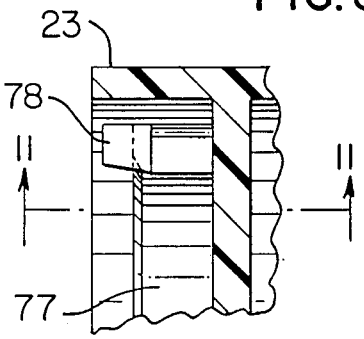
FIG. 10 is an enlarged fragmentary cross-sectional view taken on line 10—10 of FIG. 8.
Figure 11:
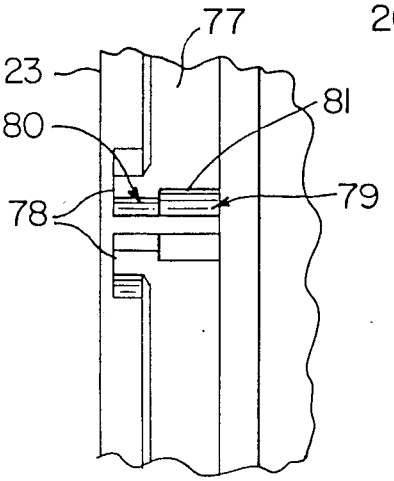
FIG. 11 is a fragmentary cross-sectional view taken on line 11—11 of FIG. 10.
Figure 9:
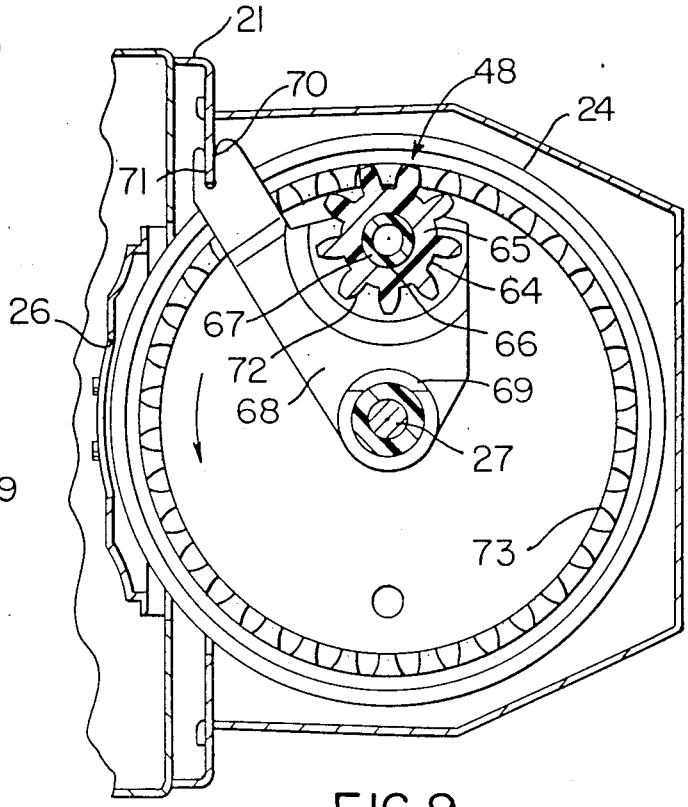
FIG. 9 is a fragmentary cross-sectional view taken on line 9—9 of FIG. 6.
Figure 14:
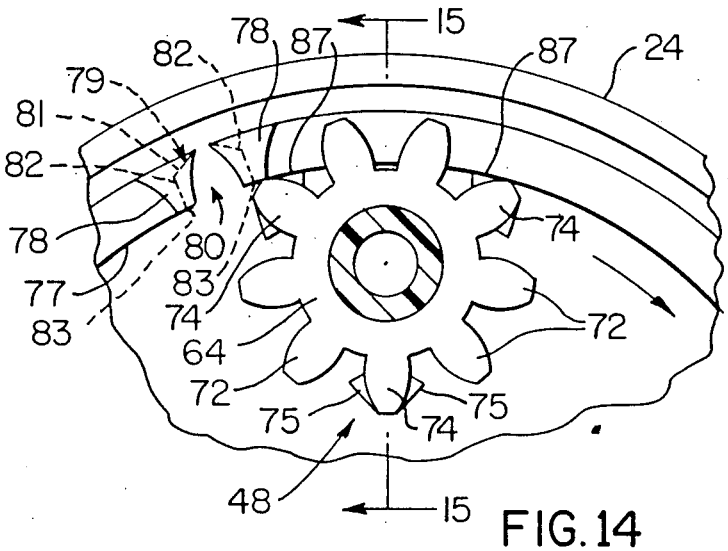
FIG. 14 is an enlarged fragmentary view of the pinion gear and the cooperating ten minutes indicating drum means of FIG. 12 with FIG. 14 illustrating the same in one operating condition thereof.
Figure 16:
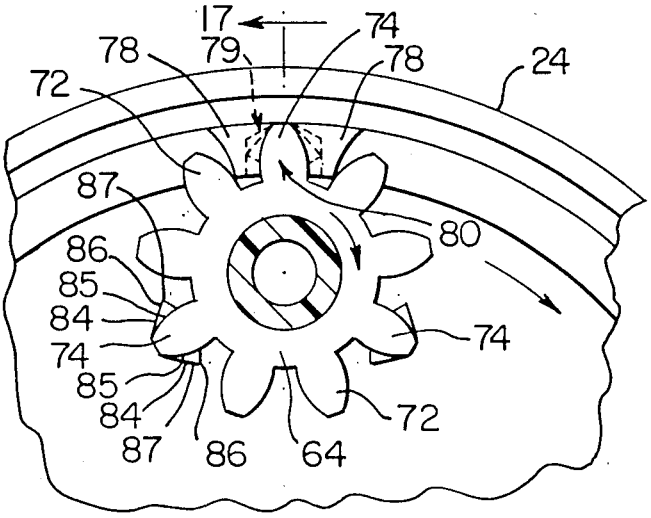
FIG. 16 is a view similar to FIG. 14 and illustrates another operating condition wherein one of the locking teeth of the pinion gear 16 is fully disposed in the cooperating relief portion of the ten minute indicating drum means.
Figure 18:
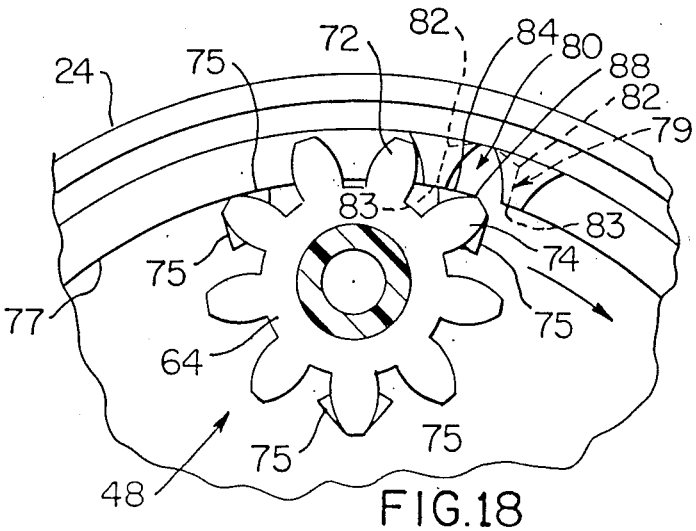
FIG. 18 is a view similar to FIGS. 14 and 16 and illustrates the operating condition of the pinion gear and the ten minute drum means immediately after the pinion gear has been advanced by a certain timed increment of movement of the ten minute drum means.

The minute indicating drum means 23 has an annular internal locking surface 77 and carries a pair of spaced apart kicker teeth 78 adjacent thereto, the minute drum means 23 having a relief that is generally indicated by the reference numeral 79 formed in the locking surface 77 thereof as illustrated in FIGS. 8, 10 and 11 for receiving one of the locking teeth 74 therein will its respective driving tooth 72 is being received in the space 80 formed between the kicker teeth 78 as illustrated in FIG. 16, the relief 79 in the locking surface 77 having an enlarged portion 81 adapted to receive the part 75 of the respective locking tooth 74 therein as illustrated in FIG. 16 and defining a pair of opposed side wall means 82 that, in turn, define a pair of spaced apart corner means 83 with the locking surface means 77 as illustrated in FIGS. 14, 16 and 18 for a purpose hereinafter set forth.

Figure 12:
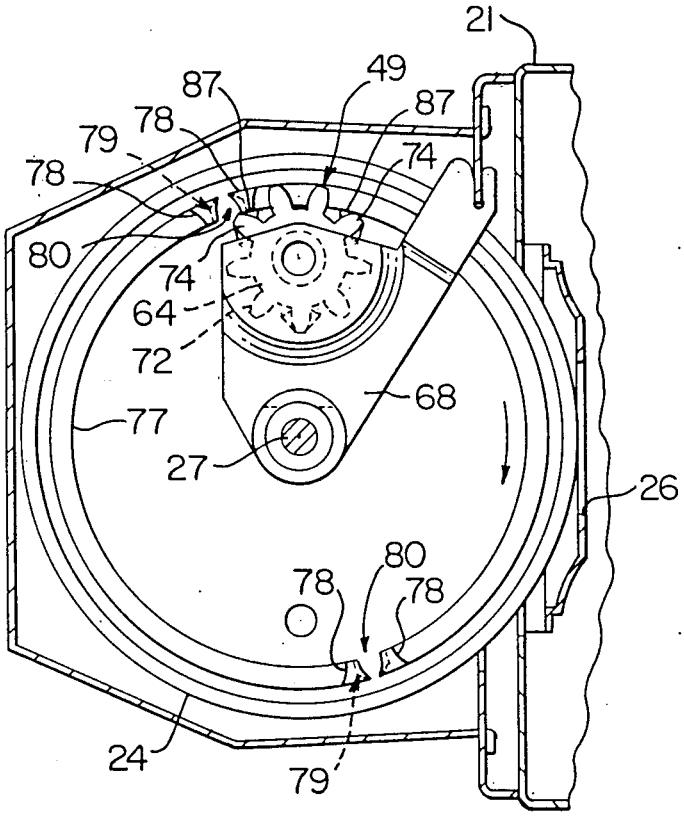
FIG. 12 is a fragmentary cross-sectional view taken on line 12—12 of FIG. 6.
Figure 13:
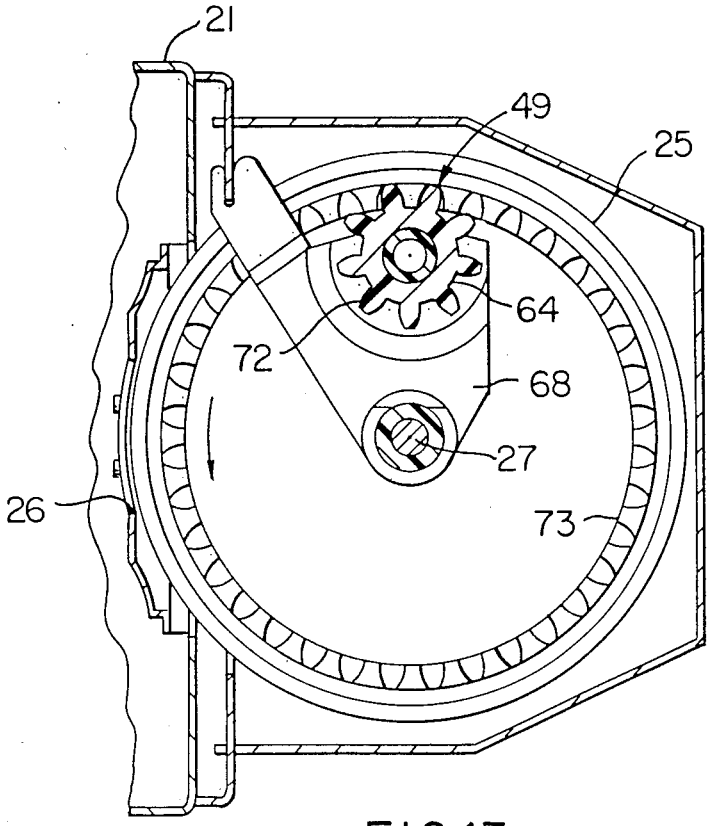
FIG. 13 is a fragmentary cross-sectional view taken on line 13—13 of FIG. 6.

The ten minute indicating drum means 24 likewise has an internal annular locking surface 77 while having two like pairs of kicker teeth 78 disposed diametrically opposite each other in the manner illustrated in FIG. 12 and respectively having the reliefs 79 formed in the locking surface 77 adjacent the respective pairs of kicker teeth 78 as illustrated.

The unique part 75 for each kicker tooth 74 of the pinion gear 64 of this invention comprises a wing-like structure that has two like sections 84 that respectively extend from opposite sides 85 of the respsective locking tooth 74 with each section 84 being substantially triangular in configuration and defining an outwardly extending abutment or apex 86 to be utilized in a manner hereinafter set forth, each section 84 having an outer end surface 87 that is defined by a radius that is substantially the same length as the radius that defines the locking surfaces 77 of the drum means 24 and 25. In this manner, the end surfaces 87 of a pair of adjacent locking teeth 74 on a particular pinion gear 64 are adapted to have the respective locking surface 77 slide thereon, as well as on the tip portions 88 of those two locking teeth 74, as that respective locking surface 77 rotates relative thereto and holds that particular pinion gear 64 from rotating in a manner well known in the art and as illustrated in FIGS. 8, 12 and 14.

From the above, it can be seen that the digital clock construction 20 of this invention can be formed from the various parts previously described by the method of this invention to operate in a manner now to be described, the part to be made from any suitable material in any suitable manner as is well known in the art.

As long as the kicker teeth 78 of the drum means 23 and 24 are respectively out of meshing relation with the driving teeth 72 of the respective pinion gears 64, the locking surface 77 of the drum means 23 and 24 are sliding against respective pairs of locking teeth 74 on the respective pinion gears 64 so as to prevent rotation of the pinion gears 64 so that the drum means 24 and 25 cannot rotate relative to each other and are properly aligned in the window means 26 of the frame means 21 as illustrated in FIG. 1.

However, each minute, the Geneva clutch means 56 causes rotation of the shaft means 27 through 36° which causes the minute indicating drum means 23 to likewise rotate 36° so as to bring a new minute number 42 into position at the window means 26, the locking surface 77 of the drum means 23 sliding on the pair of adjacent locking teeth 74 of the pinion gear 64 of the pinion gear means 48 so as to prevent rotation of the ten minute gear means 24 until the particular increment of movement of the minute indicating drum means 23 that advances from showing the "9" number 42 in the window means 26 to the showing of the "0" number 42 in the window means 26 at which time the leading kicker tooth 78 of the drum means 23 engages against a drive tooth 72 of the gear 64 of the pinion gear means 48 and begins to cause rotation of that pinion gear 64 so that the next adjacent driving tooth 72 thereof moves into the space 80 between the kicker teeth 78 and its respective locking tooth 74 is received in the relief 79 in the locking surface 77 as illustrated in FIG. 16. Further rotation of the drum 23 through the remaining 18° of the 36° of movement thereof causes the trailing kicker tooth 78 to continue rotating the pinion gear 64 by engaging against the driving tooth 72 between the kicker teeth 78 whereby rotation of the gear 64 causes that drive tooth 72 and its associated locking tooth 74 to be respectively released from the space 80 and relief 79 so that the locking surface 77 thereof can now engage against that released locking tooth 74 and the next trailing locking tooth 74 so as to prevent further rotation of the pinion gear 64 of the pinion gear means 48, such rotation of the pinion gear 64 of the pinion gear means 48 by the minute indicating drum means 23 causing a 30° rotation of the ten minute indicating drum 24 so as to bring a new ten minute number 44 thereof into the window means 26 of the clock construction.

Thus, the ten minute indicating drum means 24 is rotated 30° each time the minute indicating drum means 23 has been incrementally rotated 360°.

Such rotation of the ten minute indicating drum means 24 does not cause rotation of the hour indicating drum means 25 as the locking surface means 77 of the ten minute indicating drum means 24 is operating on the adjacent pair of locking teeth 74 of the pinion gear 64 of the pinion gear means 49, such as in the manner illustrated in FIG. 14, to prevent rotation of that pinion gear 64.

However, when the ten minute indicating drum means 24 has a pair of kicker teeth 78 thereof being moved so that the leading kicker tooth 78 thereof engages against one of the driving teeth 72 of the pinion gear 64 of the pinion gear means 49, such movement will cause the pinion gear 64 to rotate in the manner previously described so that the next adjacent driving tooth 72 and its associated locking tooth 74 will be respectively received in the kicker teeth opening 80 and the relief 79 in the manner illustrated in FIG. 16. Further rotation of the drum means 24 through the remaining 15° of its 30° of movement causes the trailing kicker tooth 78 to cause further rotation of the pinion gear 64 in the manner illustrated in FIG. 18 whereby that driving tooth 72 and its associated locking tooth 74 clear from the space 80 and the relief 79 as illustrated in FIG. 18, such rotation of the pinion gear 64 of the pinion gear means 49 causing the hour indicating drum means to rotate 30° and thereby bring a new hour number 46 thereon to the window means 26.

However, since the ten minute drum means 24 is only being rotated 30° by the pinion gear means 48 at the time that the ten minute drum means 24 is causing the 30° of rotation of the hour drum means 25 through the rotation of the pinion gear means 49 as previously set forth, it can be seen in FIG. 18 that the locking surface 77 of the ten minute indicating drum means 24 has not come into contact with the tip 88 of the forward locking tooth 74 as the tip 88 is disposed adjacent the relief 79 even though the trailing locking tooth 74 is in contact with the locking surface 77 as illustrated in FIG. 18.

Such a condition is illustrated in FIG. 19, and it can be seen that the prior art pinion gear 64' can now rotate a substantial amount in a counterclockwise direction in FIG. 19 until the driving tooth 72' that is adjacent the opening 80' will make contact with the edge 89' of the training kicker tooth 78' and this will cause the hour indicating drum means to rotate a substantial amount until the ten minute indicating drum means is subsequently advanced through another 30° increment of movement thereof. Accordingly, until such further rotation of the ten minute indicating drum means, the prior known hour indicating drum can rotate an amount sufficient to misalign its number in the window means of its clock construction.

In contrast, with the unique arrangement of this invention that is illustrated in FIG. 18, it can be seen that the apex or abutment 84 on the section 84 of the wing-like structure 75 of the cleared locking tooth 74 will substantially immemdiately engage against the corner means 83 of the relief portion 81 so as to prevent any rotation of the pinion gear 64 in a counterclockwise direction in FIG. 18 and the trailing locking tooth 74 of the pinion gear 64 is preventing any rotation of the pinion gear 64 in a clockwise direction in FIG. 18 whereby the hour drum means 25 of this invention is substantially locked in positive alignment with the ten minute drum means 24 after the initial rotation of the hour indicating drum means 25 by the ten minute indicating drum means 24 as illustrated in FIG. 18 even though the cleared locking tooth 74 of the pinion gear 64 of the pinion gear means 49 is in alignment with the relief 79 of the locking surface 77 of the ten minute indicating drum means 24 so as to be out of engagement with the locking surface 77 thereof as illustrated in FIG. 18.

Therefore, it can be seen that the wing-like parts 75 on the locking teeth 74 of the pinion gear 64 of the pinion gear means 49 of this invention overcomes or substantially eliminates a misalignment problem provided by the prior known pinion gear means 64' that is illustrated in FIG. 19.

While such misalignment problem is not provided between the minute indicating drum means 23 and the ten minute indicating drum means 24 because the movement of the minute indicating drum means 23 is approximately 36° so as to bring the locking surface 77 thereof adjacent the cleared locking tooth 74 of the pinion gear 64 of the pinion gear means 48 whereas the movement of the ten minute indicating drum means 24 is only approximately 30° so that the relief 79 of the minute indicating drum means 23 is moved beyond the locking tooth 74 on the pinion gear 64 of the pinion gear means 48, such pinion gear 64 of the pinion gear means 48 can be provided with the improved parts 75 on the locking teeth 74 thereof to minimize using different pinion gears 64 for the respective pinion gear means 48 and 49.

Figure 7:
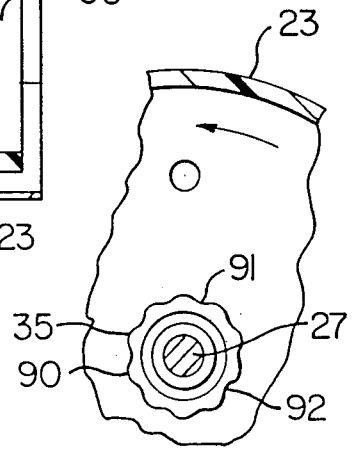
FIG. 7 is a fragmentary cross-sectional view taken on line 7—7 of FIG. 6.
Figure 5:
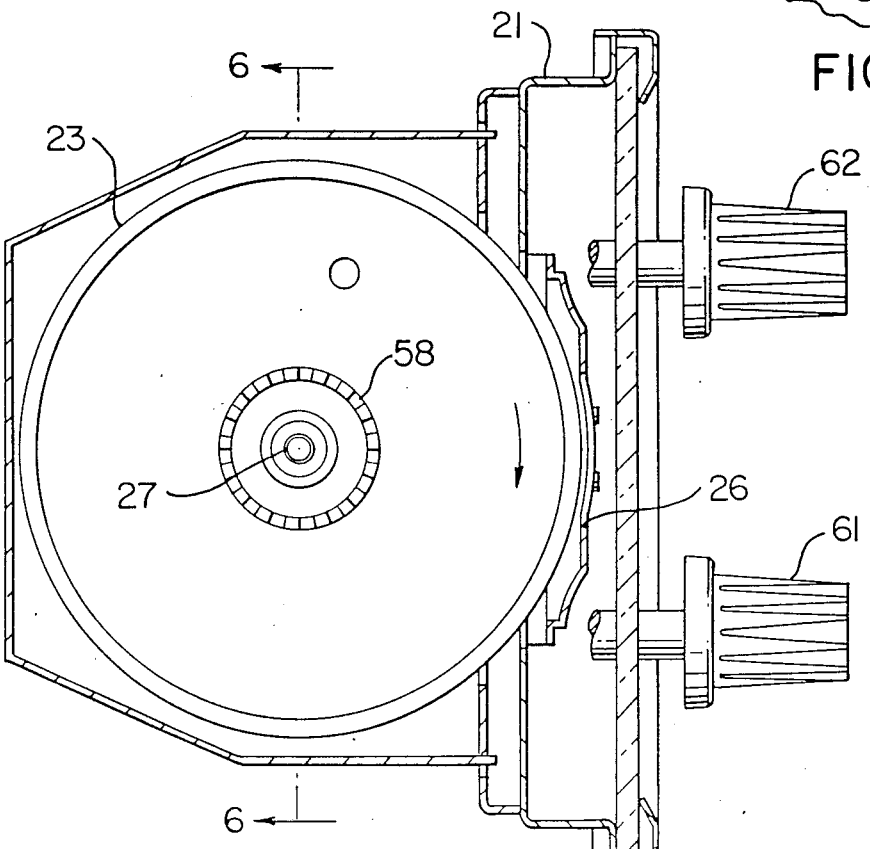
FIG. 5 is an enlarged cross-sectional view taken on line 5—5 of FIG. 1.

Also, in order to hold the minute indicating drum means 23 in its rotated positions, a portion 90 of the hub 35 thereof can be provided with an undulating surface 91 as illustrated in FIG. 7 which can cooperate with a leaf spring (not shown) carried by the frame means 21 and which will be received in a pocket 92 of the undulating surface 91 at each increment of movement of the drum means 23 so as to positively hold the particular number 42 thereof in the window means 26 of the clock construction 20 until the minute indicating drum means 23 is further rotated by the drive shaft 27 in the manner previously described.

Therefore, it can be seen that this invention not only provides a new digital clock construction and a new pinion gear for a digital clock construction, but also this invention provides new methods of making such a digital clock construction and such a pinion gear.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a pinion gear for a digital clock construction, said pinion gear being adapted to be rotatably carried and having driving gear teeth, said pinion gear having locking teeth extending from certain of said driving teeth in axially aligned relation therewith, each said locking tooth having an outer tip that is defined by a certain radius extending from the center of said pinion gear, each said locking tooth having a free end remote from its respective driving tooth, the improvement wherein said locking teeth each has a wing-like structure at said free end and that extends transversely outwardly from both sides thereof and from said tip thereon whereby each said wing-like structure is axially spaced from its respective driving tooth.

2. A pinion gear for a digital clock construction as set forth in claim 1 wherein said wing-like structure of each said locking tooth has a section thereof on each said side of the respective locking tooth, each said section having an outer end surface that is defined by a radius.

3. A pinion gear for a digital clock construction as set forth in claim 2 wherein each said section of each said locking tooth has a generally triangular configuration.

4. In a method of making a pinion gear for a digital clock construction, said method comprising the steps of forming said pinion gear to be adapted to be rotatably carried and have driving gear teeth, forming said pinion gear to have locking teeth extending from certain of said driving teeth in axially aligned relation therewith, forming each said locking tooth to have a free end remote from its respective driving tooth, and forming each said locking tooth to have an outer tip that is defined by a certain radius extending from the center of said pinion gear, the improvement comprising the step of forming said locking teeth to each have a wing-like structure at said free end and that extends transversely outwardly from both sides thereof and from said tip thereof whereby each said wing-like structure is axially spaced from its respective driving tooth.

5. A method of making a pinion gear for a digital clock construction as set forth in claim 4 and including the steps of forming said wing-like structure on each said locking tooth to have a section thereof on each said side of the respective locking tooth, and forming each said section to have an outer end surface that is defined by a radius.

6. A method of making a pinion gear for a digital clock construction as set forth in claim 5 and including the step of forming each said section of each said locking tooth to have a generally triangular configuration.

* * * * *